US006701109B2

(12) United States Patent
Yoda et al.

(10) Patent No.: US 6,701,109 B2
(45) Date of Patent: Mar. 2, 2004

(54) COLOR IMAGE FORMING APPARATUS

(75) Inventors: Kaneo Yoda, Nagano (JP); Nobumasa Abe, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 70 days.

(21) Appl. No.: 10/092,724

(22) Filed: Mar. 8, 2002

(65) Prior Publication Data

US 2002/0127030 A1 Sep. 12, 2002

(30) Foreign Application Priority Data

| | | |
|---|---|---|
| Mar. 9, 2001 | (JP) | P2001-067573 |
| Mar. 9, 2001 | (JP) | P2001-067574 |
| Mar. 9, 2001 | (JP) | P2001-067575 |
| Apr. 5, 2001 | (JP) | P2001-106782 |

(51) Int. Cl.[7] ..... G03G 15/00
(52) U.S. Cl. ..... 399/167
(58) Field of Search ..... 399/162, 165, 399/167, 297, 298, 299, 301, 302, 303, 308

(56) References Cited

U.S. PATENT DOCUMENTS

| | | | | |
|---|---|---|---|---|
| 5,287,162 A | * | 2/1994 | de Jong et al. | 399/49 |
| 5,508,789 A | | 4/1996 | Castelli et al. | 399/8 |
| 5,758,038 A | * | 5/1998 | Itoh et al. | 399/101 X |
| 5,825,398 A | * | 10/1998 | Furuta et al. | 347/235 |
| 6,560,434 B2 | * | 5/2003 | Chapman et al. | 399/302 |

FOREIGN PATENT DOCUMENTS

| | | |
|---|---|---|
| EP | 0 943 970 A1 | 9/1999 |
| JP | 4-38442 | 2/1992 |
| JP | 4-324881 | 11/1992 |
| JP | 11 015226 | 1/1999 |
| JP | 11 065222 | 3/1999 |
| JP | 11-231754 | 8/1999 |

* cited by examiner

*Primary Examiner*—Hoan Tran
(74) *Attorney, Agent, or Firm*—Sughrue Mion, PLLC

(57) ABSTRACT

In a color image forming apparatus, a looped belt member is stretched and circulated by at least a drive roller and a driven roller so as to have a tensed side and a slack side. Each of plural image supporting members supports a single color toner image thereon, and abuts onto the slack side of the belt member to define a transferring position at which the toner image is transferred onto either the belt member or a recording medium held by the belt member, while being rotated. A circumferential velocity of each image supporting member is determined so as to be higher than a circulation velocity of the belt member.

15 Claims, 8 Drawing Sheets

COLOR IMAGE FORMING APPARATUS

BACKGROUND OF THE INVENTION

The present invention relates to a color image forming apparatus using the electrophotographic technology such as a printer, a copy machine, a facsimile machine, or the like. More particularly, the invention relates to a color image forming apparatus in which a plurality of toner images respectively formed by a plurality of single-color toner image formers are sequentially transferred on a transferring member or a recording medium held by the transferring member.

In general, an image forming apparatus and in particular, a tandem image forming apparatus using electrophotography has a photoconductor as an image supporting member having a photosensitive layer on the outer peripheral surface thereof, a charger for uniformly charging the outer peripheral surface of the photoconductor, an exposer for selectively exposing the charged outer peripheral surface to light for forming an electrostatic latent image thereon, and a developer for giving toner to the electrostatic latent image for providing a visible image (toner image).

FIG. 7 shows an example of the tandem-type color image forming apparatus disclosed in Japanese Patent Publication No. 11-231754A. In this example, a plurality of (four) toner image formers 10*a*–10*d* each including a image supporting member 2*a*–2*d* are brought into contact with an intermediate transfer belt 1 serving as a transferring member, for sequentially transferring multiple-color toner images (for example, yellow, cyan, magenta and black) supported by the respective image supporting members 2*a*–2*d* onto the intermediate transfer belt 1. A full-color image thus formed on the intermediate transfer belt 1 is then secondarily transferred onto a recording medium P such as paper by a transfer roller 6.

There is another type of the tandem-type color image forming apparatus in which a recording medium such as paper is held and transported by a belt member serving as a transferring member so that toner image formed on the above image supporting members are sequentially transferred onto the recording medium.

In FIG. 7, the intermediate transfer belt 1 is circulated by a drive roller 3 and a driven roller 5. Therefore, the image supporting members 2*a*–2*d* are brought into contact with a slack side of the transfer belt 1.

In such a configuration, a tension roller 4 for giving a relatively large tension to the intermediate transfer belt 1 by a relatively large force F has been provided to stabilize the contact between the transfer belt 1 and the image supporting members 2*a*–2*d*. Thus, the stretching structure of the transfer belt becomes complicated so that it is difficult to reduce the size of the image forming apparatus.

Since a relatively large tension is given to the transfer belt 1 when the image forming apparatus is not activated (the transfer belt is not circulated) for a long time period, creep deformation would occur in the transfer belt, adversely affecting the later image formation.

By the way, to provide a good transfer condition of toner images (therefore providing a fine image) in the image formation apparatus as described above, it is desirable that the circumferential velocity of the image supporting member and that of the transferring member should be completely matched with each other. More practically, however, manufacturing errors and varying tolerances are usually introduced into the image supporting member, the transferring member, or the parts making up their driver units at the manufacturing stage. Thus, it is practically impossible to completely match the circumferential velocity of the image supporting member and that of the transferring member.

If the difference between the circumferential velocity of the image supporting member and that of the transferring member varies, for example, if the circumferential velocity of the image supporting member is higher than that of the transferring member at one point in time and the former becomes lower than the latter at another point in time, the transfer condition becomes remarkably unstable and a fine image cannot be obtained. Particularly, to superpose multiple-color toner images on each other for forming a full-color image as described above, a color-to-color shift occurs and the image quality is remarkably degraded.

To solve this problem, as shown in FIG. 8, Japanese Patent Publication No. 4-324881A discloses a color image forming apparatus wherein the velocity of each image supporting member is always higher than that of transferring member.

Four photoconductive drums 11 (Y, M, C, and K), each associated with a single color are brought into contact with an intermediate transfer drum 12. A yellow toner image provided by the photoconductive drum 11Y, a magenta toner image provided by the photoconductive drum 11M, a cyan toner image provided by the photoconductive drum 11C, and a black toner image provided by the photoconductive drum 11K are sequentially transferred to the intermediate transfer drum 12 to form a full-color toner image thereon, which is then transferred from the intermediate transfer drum 12 to a recording medium P.

The intermediate transfer drum 12 is driven by a driving system 14 and the photoconductive drums 11 (Y, M, C, and K) are driven by driving systems 13 (Y, M, C, and K). The driving systems 13 (Y, M, C, and K) comprise velocity converter 15 (Y, M, C, and K), respectively.

In this apparatus, to set the circumferential velocity V (Y, M, C and K) of each photoconductive drum 1 (Y, M, C and K) higher than the circumferential velocity V1 of the intermediate transfer drum 2, separate drive sources are provided. Accordingly, the driving mechanism becomes very complicated and the apparatus size is also increased.

Further, this publication is silent about fluctuation in the difference between the circumferential velocity of the image supporting members and that of the transferring member. Therefore, the transfer condition would become remarkably unstable as described above, so that a fine image cannot be provided. Particularly, when multiple-color toner images are superposed on each other for forming a full-color image as described above, a color-to-color shift would occur and the image quality is remarkably degraded.

SUMMARY OF THE INVENTION

It is therefore an object of the invention to provide a color image forming apparatus that can solve the problems as described above, can be miniaturized, and does not promote creep in a transfer belt.

It is another object of the invention to provide a color image formation apparatus which stabilizes the transfer condition from an image supporting member to a transferring member with a simple driving system.

In order to achieve the above objects, according to one embodiment of the present invention, there is provided a color image forming apparatus, comprising:

a drive roller and a driven roller;

a looped belt member stretched and circulated by at least the drive roller and the driven roller so as to have a slack side and a tensed side; and a plurality of image supporting members, each supporting a single color toner image thereon, and abutting onto the slack side of the belt member to define a transferring position at which the toner image is transferred onto either the belt member or a recording medium held by the belt member, while being rotated, wherein:

a circumferential velocity of each image supporting member is determined so as to be higher than a circulation velocity of the belt member.

In this configuration, slack in the transfer belt originally occurred in the winding release point of the drive roller, is taken up so that the transfer belt is placed in a tensed state between the respective transferring positions. Accordingly, the running condition of the transfer belt becomes stable without wrinkles or slack, and the transfer position is fixed uniquely to a predetermined position.

Further, because of this configuration, an additional tension roller as employed in the related art is not needed so that the stretching structure of the transfer belt can be simplified (the transfer belt may be looped only on the drive roller and the driven roller) and correspondingly, the size of an image forming apparatus can be reduced. Moreover, since a considerably large tension due to the provision of the tension roller does not act on the transfer belt, creep deformation is reduced or eliminated in the transfer belt even if the image forming apparatus is not activated for a long time period. Consequently, image formation and quality can be improved.

Here, it is preferable that the rotation velocities of the image supporting members are substantially the same as each other.

In another embodiment, the circumferential velocity of an image supporting member which is further from the driving roller is higher than a circumferential velocity of an image supporting member which is closer to the driving roller.

This additionally allows the transfer belt to be maintained in a tensed state between the adjacent image supporting members, allowing the running condition of the transfer belt to become reliably stable between the adjacent image supporting members.

In a preferred embodiment, the apparatus further comprises:

a first gear train, which rotates the drive roller to circulate the belt member;

a second gear train, which rotates the image supporting members, while being connected to the first gear train with no branch; and a single drive source, which drives the first gear train to thereby drive the second gear train.

In this configuration, since both of the first gear train and the second gear train are driven by the single drive source, the mechanical structure is remarkably simplified which allows for the apparatus size to be reduced. Furthermore, backlash in the first gear train does not occur although the circumferential velocity of the image supporting member is higher than the circulating velocity of the transfer belt.

Also according to the invention, a surface hardness of the belt member may be greater than a surface hardness of the respective image supporting members. Alternatively, or in addition to this surface hardness relationship, a surface roughness of the belt member may be greater than a surface roughness of the respective image supporting members.

In addition, an abrasive may be applied on a surface of the belt member.

In any of the above configurations, whenever the surface of the image supporting member comes in contact with the belt member, because of the difference between the circulating velocity of the belt member and the circumferential velocity of the image supporting member, the surface of the image supporting member which is slightly cut is always refreshed. Therefore, filming is prevented allowing the image quality to be maintained.

Preferably, the color image forming apparatus further comprises a cleaning member which abuts against a part of the belt member which is wound on the driven roller, to remove toner remained on the belt member.

In this configuration, the stretched condition of the intermediate transfer belt becomes stable even at the initial stage of image formation.

Preferably, the color image forming apparatus further comprises a secondary transfer position, formed on a part of the belt member which is wound on the driven roller, at which the toner images transferred from the image supporting members are secondarily transferred to a recording medium. The recording medium passes through the secondary transfer position upward from a lower part of the apparatus.

In this configuration, it is not necessary to provide the individual transfer roller inside of the transfer belt as shown in FIG. 5, so that it is possible to downsize the stretching structure of the transfer belt, thereby reducing the size of the apparatus.

Here, it is preferable that the color image forming apparatus further comprises a fixing section at which the secondarily transferred toner image is fixed on the recording medium. The fixing section is placed above the plurality of image supporting members.

In this configuration, heat or water vapor generated from the fixing section can be prevented from invading into the image forming section, so that it is possible to prevent occurrence of an image failure caused by temperature fluctuation, a registration shift caused by thermal expansion, an image failure caused by dew condensation, sticking of the contact parts, or the like.

In another embodiment according to the present invention, there is also provided a color image forming apparatus, comprising:

a transferring member;

at least one image supporting member, which supports a single color toner image thereon, and abutting onto the transferring member to define a transferring position at which the toner image is transferred onto either the transferring member or a recording medium held by the transferring member, while being rotated;

a first gear train, which rotates the transferring member;

a second gear train, which rotates the at least one image supporting member, while being connected to the first gear train with no branch; and a single drive source, which drives the first gear train to thereby drive the second gear train, wherein a circumferential velocity of the at least one image supporting member is higher than a circumferential velocity of the transferring member.

In this configuration, since the circumferential velocity of the transferring member is higher than the circumferential velocity of each image supporting member, the variation in the circumferential velocity difference between the respective image supporting members and the transferring member can be minimized. This makes it possible to stabilize the transferring condition of the toner image of each color from each of the image supporting members to the transferring member to provide a fine image.

Furthermore, since both of the first gear train and the second gear train are driven by the single drive source, the mechanical structure is remarkably simplified which allows for the apparatus size to be reduced.

Moreover, backlash in the first gear train does not occur even though the circumferential velocity of the transferring member is greater than the circumferential velocity of the respective image supporting members. Therefore, the above relationship between the rotation velocities can be reliably provided.

Particularly in the tandem-type color image forming apparatus, not only the driving mechanism for the plural image supporting members and the transferring member is remarkably simplified, but also a fine color image with no color shift can be reliably obtained.

In this embodiment, the surface hardness of the transferring member may also be greater than a surface hardness of the respective image supporting members. Alternatively, or in addition to this surface hardness relationship, a surface roughness of the belt member may be greater than a surface roughness of the respective image supporting members.

Furthermore, an abrasive may be applied on a surface of the transferring member.

In any of the above configurations, whenever the surface of the image supporting member comes in contact with the transferring member, because of the difference between the circumferential velocity of the transferring member and the circumferential velocity of the image supporting member, the surface of the image supporting member which is slightly cut is always refreshed. Therefore, the filming is prevented so that the image quality is maintained.

BRIEF DESCRIPTION OF THE DRAWINGS

The above objects and advantages of the present invention will become more apparent by describing in detail preferred embodiments thereof with reference to the accompanying drawings, wherein.

DETAILED DESCRIPTION OF THE PREFERRED EMBODIMENTS

Preferred embodiments of the present invention will be described below in detail with reference to the accompanying drawings.

Figure 1:
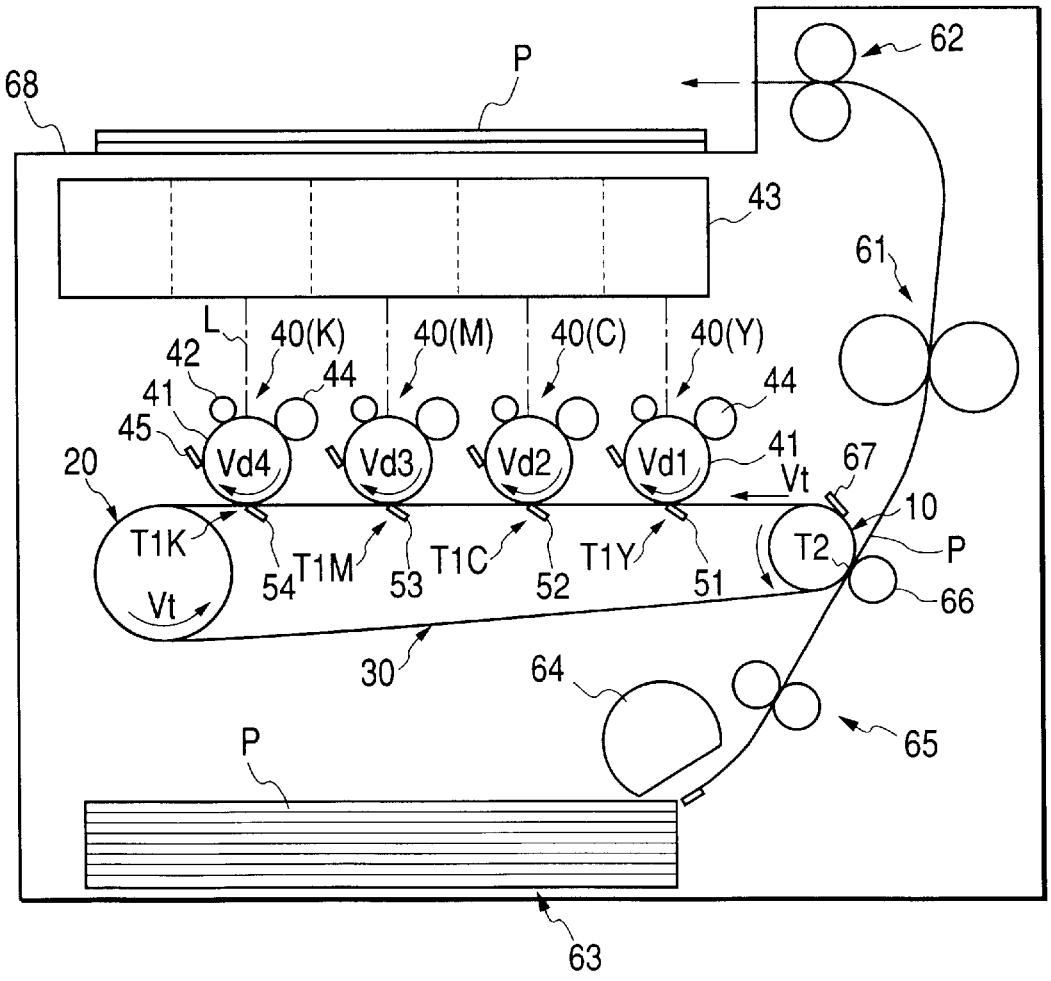
FIG. 1 is a schematic front view to show a color image forming apparatus according to one embodiment of the invention.

In a color image forming apparatus shown in FIG. 1, an intermediate transfer belt 30 is looped on a drive roller 10 and a driven roller 20 and circulated in the arrow direction (counterclockwise). A plurality of (four) single-color toner image formers 40(Y, C, M, and K) are brought into contact with the intermediate transfer belt 30 for sequentially transferring toner images thereon with the aid of individual transferring members 51, 52, 53, and 54 which define respective primary transferring positions T1Y, T1C, T1M, and T1K.

Each of the single-color toner image formers 40(Y) for yellow, 40(M) for magenta, 40(C) for cyan, and 40(K) for black has a photoconductor 41 having a photosensitive layer on the outer peripheral surface thereof, as an image supporting member, a charging roller 42 for uniformly charging the outer peripheral surface of the photoconductor 41, an exposer 43 for selectively exposing the charged outer peripheral surface to light L for forming an electrostatic latent image thereon, a developing roller 44 for giving toner to the electrostatic latent image for providing a visible image (toner image), and a cleaning blade 45 for removing toner remaining on the surface of the photoconductor 41 after the toner image is primarily transferred to the intermediate transfer belt 30.

A full-color toner image provided by sequentially transferring the toner images to the intermediate transfer belt 30 so as to superpose the toner images on each other is secondarily transferred to a recording medium P such as paper in a secondary transferring position T2. Then, the image is fixed on the recording medium P as it passes through a fixing roller pair 61, and is ejected onto an ejection tray 68 formed on the top of the apparatus through an ejection roller pair 62.

In a paper feeding cassette 63, a large number of recording media P are stacked. A pickup roller 64 feeds the recording media P one at a time from the paper feeding cassette 63. A gate roller pair 65 defines the supply timing of the feed recording medium P to the secondary transferring position T2. A secondary transfer roller 66 defines the secondary transferring position T2 together with the intermediate transfer belt 30. A cleaning blade 67 removes toner remaining on the surface of the intermediate transfer belt 30 after the secondary transfer.

The image supporting members 41 of the single-color toner image formers 40(Y, C, M, and K) are brought into contact with the slack side of the intermediate transfer belt 30. The circulating velocity Vt of the transfer belt 30 may be lower than the circumferential velocity Vdi (Vd1, Vd2, Vd3, Vd4) of each of the image supporting members 41, namely, $Vt<Vdi$. Also, in this embodiment, the respective rotation velocities of the image supporting members 41 are made identical with each other, namely, $Vd1=Vd2=Vd3=Vd4$. Of course, this does not preclude setting the circulating velocity and rotation velocities at different relationships as described in a second embodiment description that follows.

According to the above configuration, when the apparatus is activated (the transfer belt 30 and the image supporting members 41 are rotated), as the image supporting members 41 start to rotate, the tension for decreasing the slack of the transfer belt 30 acts on the contact part between the transfer belt 30 and each image supporting member 41 (primary transferring position T1).

Figure 2:
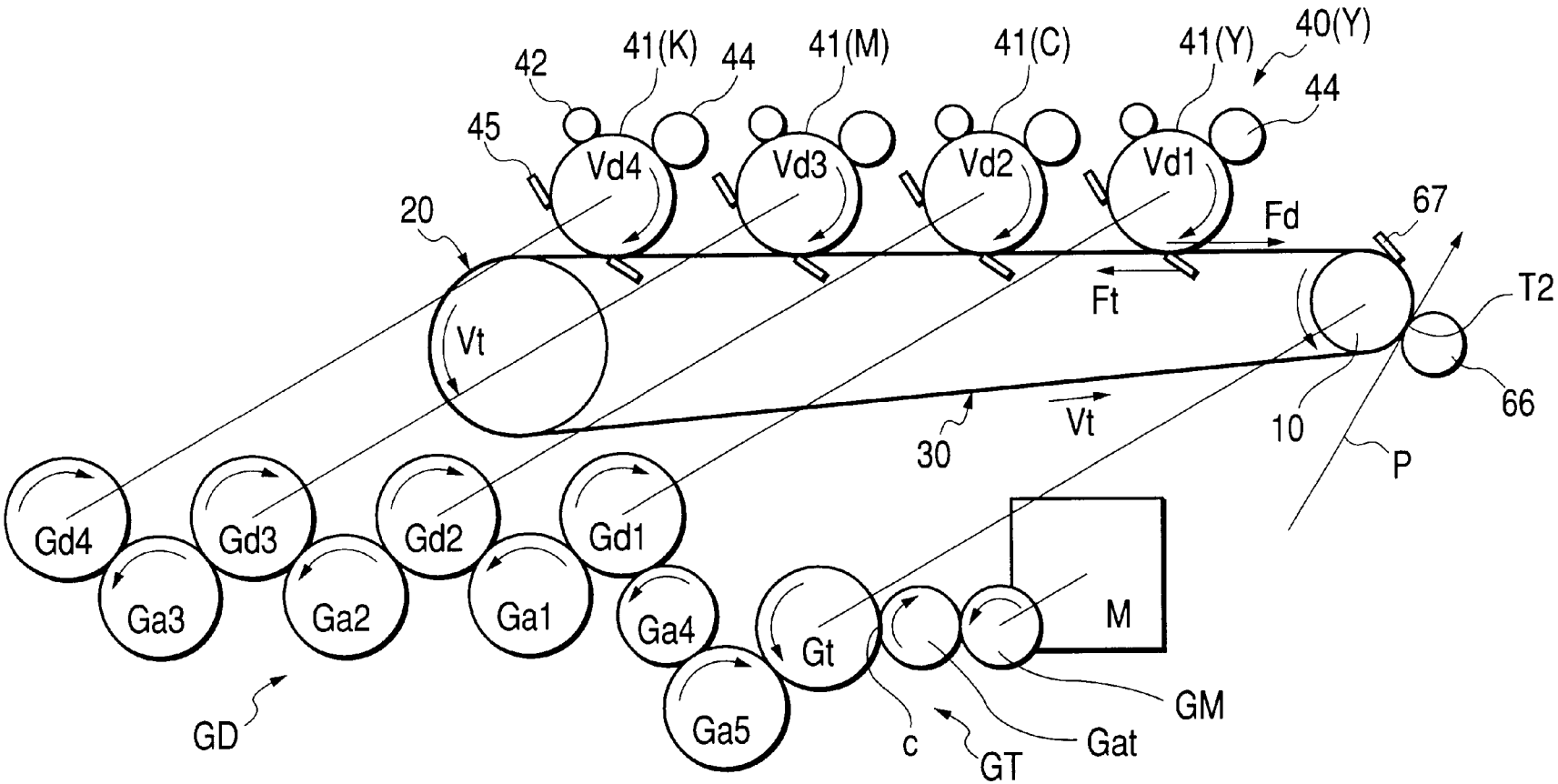
FIG. 2 is a drawing to show a driving system of image supporting members and a transfer belt in the embodiment.

More particularly, when the image supporting member 41 abuts the transfer belt 30 at the velocity Vdi higher than the velocity of the transfer belt 30, the following friction force occurs in the contact part therebetween:

$Ft=\mu Q$(see FIG. 2)

where $\mu$ represents the friction coefficient between image supporting member 41 and transfer belt 30, and Q represents the abutment load acting therebetween.

As shown in FIG. 2, a portion of the transfer belt 30 situated between a winding release point of the drive roller 10 and a contact point with the image supporting member 41 is pulled in a direction that the friction force Ft acts. Since some slip occurs in each transferring position (contact part), the friction force (belt tensing force) Ft occurs in each transferring position (T1) and absorbs slack in the transfer belt 30 originally occurred in the winding release point of the drive roller 10, so that the transfer belt 30 is placed in a tensed state between the respective transferring positions. Accordingly, the running condition of the transfer belt 30 becomes stable without wrinkles or slack, and the transfer position is fixed uniquely to a predetermined position.

Figure 7:
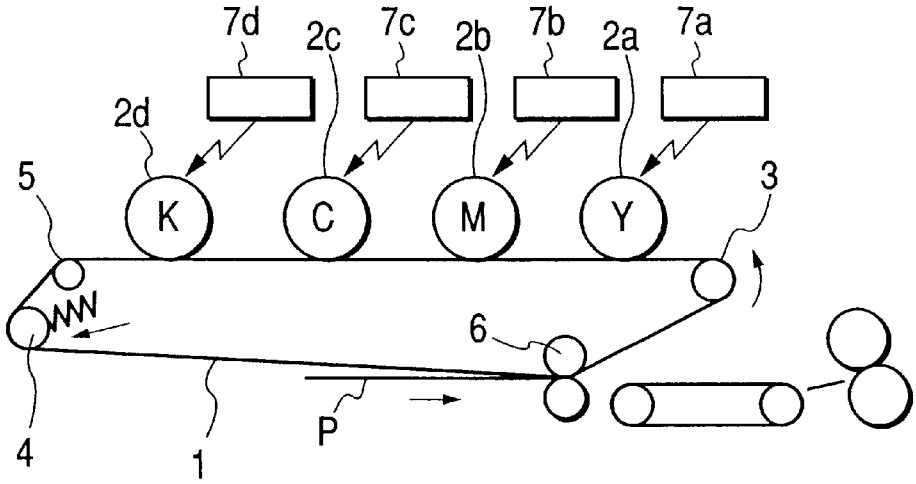
FIG. 7 PRIOR ART
FIG. 7 is a schematic front view to show a related color image forming apparatus.
Figure 8:
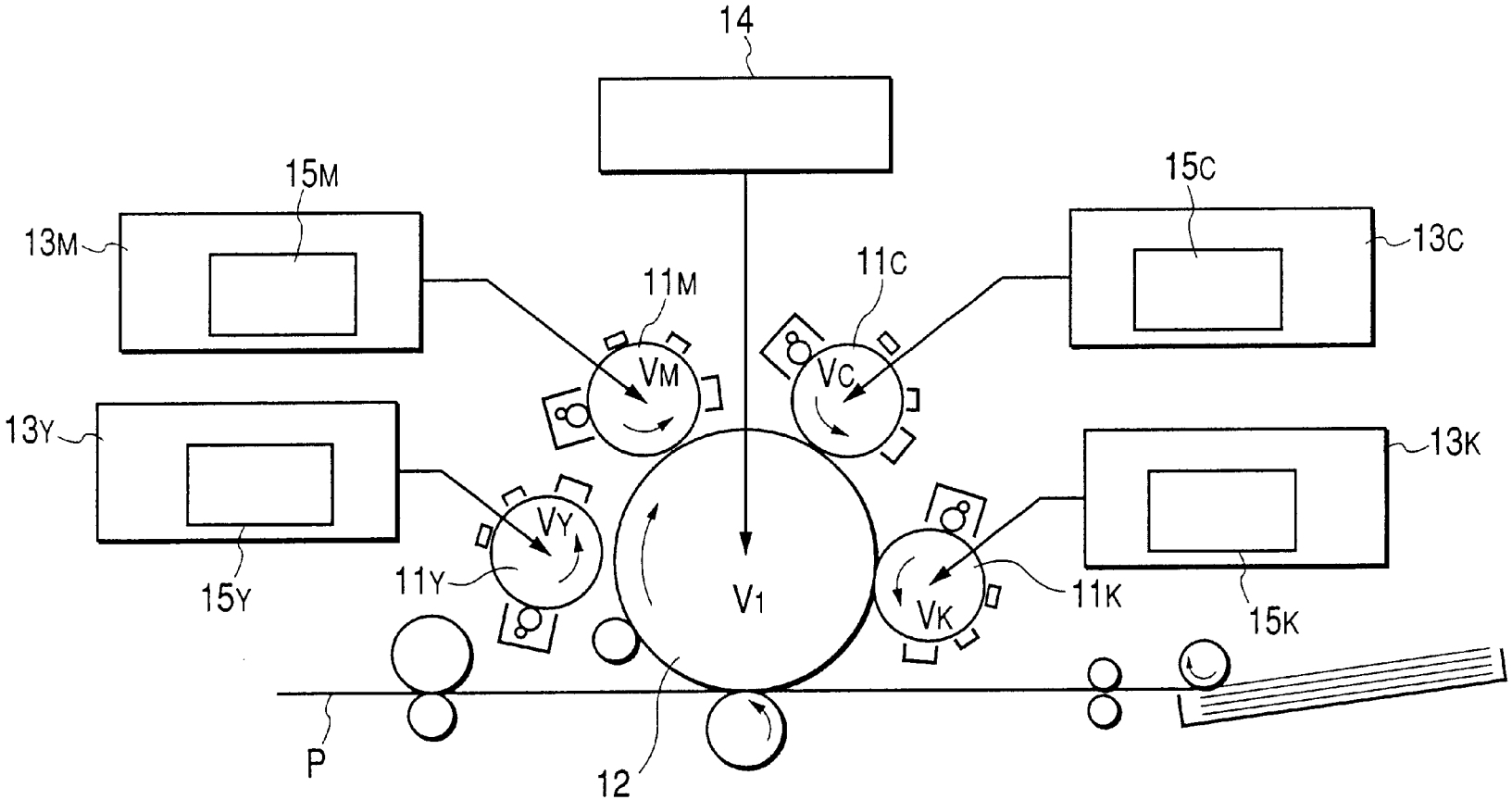
FIG. 8 PRIOR ART
FIG. 8 is a schematic front view to show another related color image forming apparatus.

Therefore, although the image supporting members 41 of the single-color toner image formers 40 are placed in contact with the slack side of the transfer belt 30, it is made possible to stabilize the contact state between the transfer belt 30 and the image supporting members 41 if such a tension roller 4 as shown in FIG. 7 is not necessarily provided, so that it is made possible to provide an image with a good registration (less color-to-color shift).

That is, the stretching structure of the transfer belt 30 can be simplified (the transfer belt 30 may be looped only on the drive roller 10 and the driven roller 20) so the size of an image forming apparatus can be reduced. Moreover, since a considerably large tension due to the provision of the tension roller does not act on the transfer belt 30, and only the necessary minimum tension required for driving the transfer belt 30 may be added, creep deformation is reduced or eliminated in the transfer belt 30 even if the image forming apparatus is not activated for a long time period. Consequently, image formation and quality can be improved.

Moreover, as the tension given to the belt may be small, the meander force acting on the belt decreases so that the meandering action of the belt can be sufficiently prevented by merely providing a simple press member, or the like. Therefore, complicated meander prevention control also becomes unnecessary.

Since the rotation velocities Vd1–Vd4 of the respective image supporting members 41 are made identical with each other, the cycle of the velocity difference occurring because of eccentricity of the image supporting members 41 can be made constant. By matching the eccentric phases of the image supporting members 41 with each other, the registration accuracy (color-to-color shift prevention) can be improved. Further, the writing timing of a latent image by the exposer 43 onto each of the photoconductors of the image supporting members 41 can be made common for simplifying the control system.

As shown in FIG. 2, the apparatus is provided with a first gear train GT for driving the intermediate transfer belt 30 and a second gear train GD for driving the image supporting members 41. Both gear trains are driven by a single drive source gear GM. The second gear train GD is driven through the first gear train GT so that the gear train from the drive source gear GM to a gear Gd4 at the last stage is implemented as a single gear train with no branch.

That is, the drive source gear GM is fixed to an output shaft of a motor M to be driven. A gear Gt meshes with the drive source gear GM through an idle gear Gat, whereby the drive roller 10 is driven at the circumferential velocity Vt(<Vd1). A gear Gd1 meshes with the gear Gt through idle gears Ga5 and Ga4, whereby the image supporting member 41 (Y) is driven at the circumferential velocity Vd1. Next, a gear Gd2 meshes with the gear Gd1 through an idle gears Ga1, whereby the image supporting member 41(C) is driven at the circumferential velocity Vd2(=Vd1). Further, a gear Gd3 meshes with the gear Gd2 through an idle gear Ga2, whereby the image supporting member 41(M) is driven at the circumferential velocity Vd3 (=Vd1). Finally, the last stage gear Gd4 meshes with the gear Gd3 through an idle gears Ga3, whereby the image supporting member 41(K) is driven at the circumferential velocity Vd4 (=Vd1).

Therefore, the second gear train GD (gears Ga5, Ga4, Gd1, Ga1, Gd2, Ga2, Gd3, Ga3, and Gd4) is driven through the first gear train GT (gears Gat and Gt), so that the gear train from the drive source gear GM to the last stage gear Gd4 is implemented as a single gear train with no branch.

According to the above configuration, backlash in the first gear train GT does not occur although the circumferential velocity Vd of the image supporting member 41 is higher than the circulating velocity Vt of the transfer belt 30.

Specifically, when the above described friction force Ft occurs, it acts on the transfer belt 30 as an acceleration (tensile) force in each contact part (T1). In the description to follow, the image supporting member 41(Y) is taken as a representative. The force Ft is transmitted to the gear Gt via the transfer belt 30.

Figure 3:
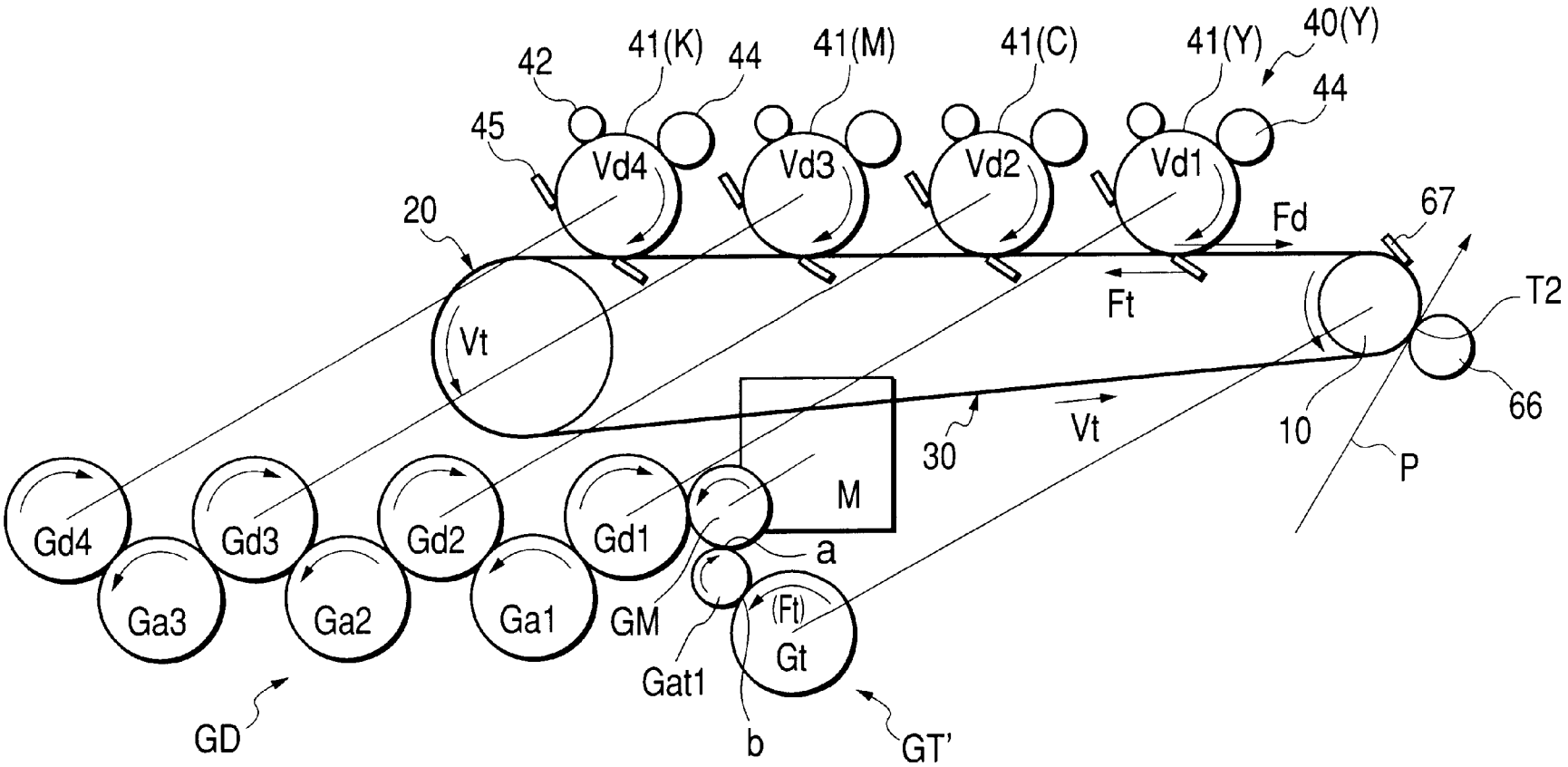
FIG. 3 is a drawing to show a driving system of an image supporting members and a transfer belt in a comparative example.
Figure 4A:
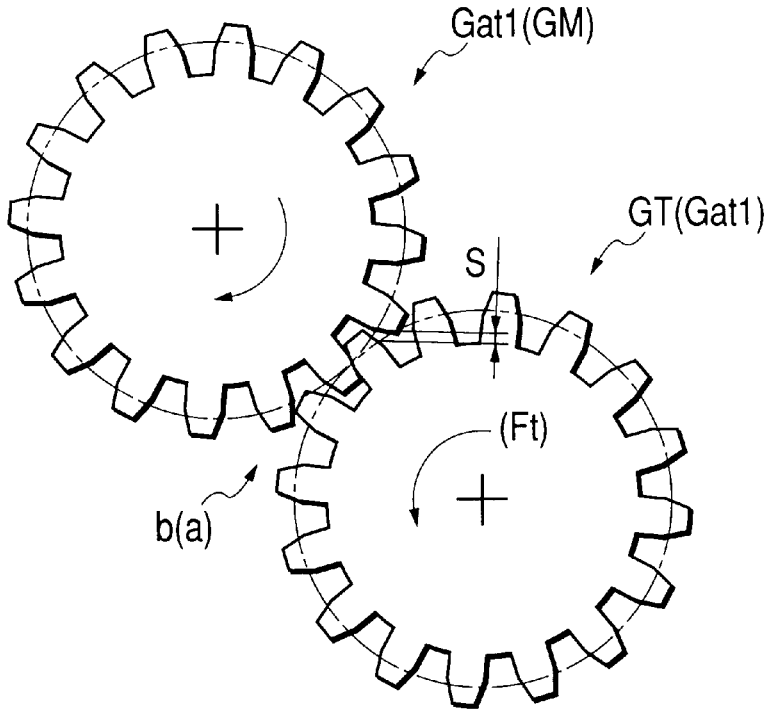
FIG. 4A is a drawing to explain backlash occurred in a driving system of a comparative example.

As an example, as shown in FIG. 3, assume that the first gear train is separated from the second gear train GD as a gear train GT' so as to independently drive the transfer belt 30 (in this case, the drive roller 10) from the drive source gear GM via an idle gear Gat1 and the gear Gt. In this case, the force Ft transmitted to the gear Gt via the transfer belt 30 becomes a force attempting to rotate the gears Gt and Gat1 at a higher rate than the predetermined number of revolutions (at equal velocity to the circumferential velocity of the image supporting member 41). Thus, there is a probability that backlash S will occur in a mesh part b of the gears Gt and Gat1 as shown in FIG. 4A (or a mesh part a of the gears Gat1 and GM shown in FIG. 3), placing the transfer belt 30 in an unstable rotation state.

Figure 4B:
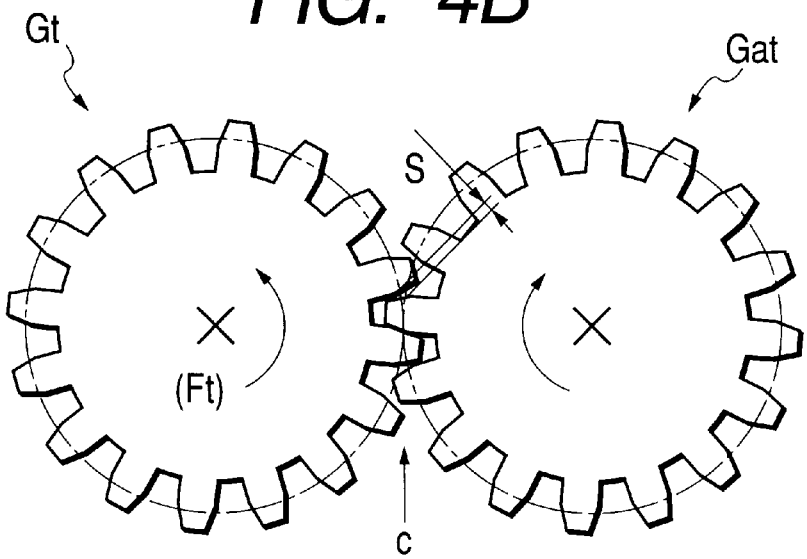
FIG. 4B is a drawing to explain backlash occurred in a driving system of the embodiment.

In contrast, according to the embodiment, if the force Ft acts as a force attempting to rotate the gears Gt and Gat at a higher rate than the predetermined number of revolutions (at equal velocity to the circumferential velocity of the image supporting member 41) and backlash S is about to occur as shown in FIG. 4B, power transmission from the idle gear Gat to the gear Gt is not conducted so that power transmission to the image supporting member 41 (the second gear train GD at the following stage of the gear Gt) accelerated relative to the transfer belt 30 cannot be conducted either. That is, the backlash as shown in FIG. 4A cannot be realized. Therefore, the running condition of the transfer belt 30 becomes stable, so that good color superposing accuracy can be attained.

Particularly in this type of color image forming apparatus wherein a plurality of single-color toner images forming multiple-color toner images are brought into contact with an intermediate transfer belt for sequentially transferring the toner images so as to superpose on the intermediate transfer belt, the transferring condition from the image supporting members to the transfer belt can be stabilized with a simple driving system, so that a fine image may be obtained.

Although it is not shown, the above advantages can be attained also in a type of a color image forming apparatus wherein multiple-color toner images are transferred on a recording medium such as paper which is held and transported by a transferring member such as a transport belt.

As also shown in FIG. 1, the secondary transferring position T2 for transferring a full-color toner image from the intermediate transfer belt 30 to the recording medium P is formed in the part of winding the intermediate transfer belt 30 around the drive roller 10 and the secondary transfer roller 66. The recording medium P passes through the secondary transferring position T2 upward from the lower side.

According to the above configuration, it is not necessary to provide the individual transfer roller 6 inside of the transfer belt as shown in FIG. 7, so that it is possible to downsize the stretching structure of the transfer belt, thereby reducing the size of the apparatus.

The drive roller 10 has a shaft fixed at both ends by bearings, etc., for rotation (not shown) and the shaft core is not displaced, so that it is made possible to form the stable secondary transferring position T2.

Figure 5:
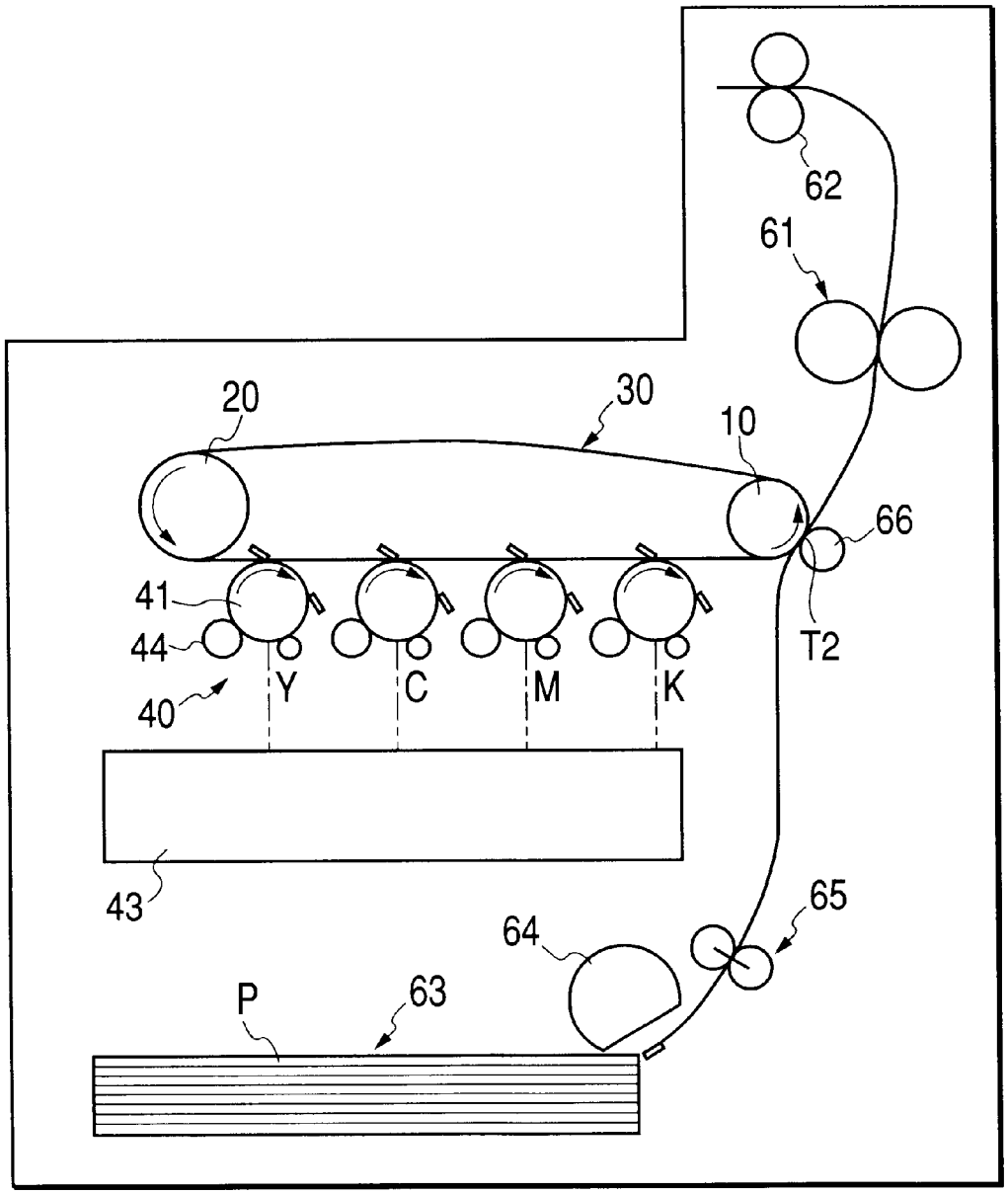
FIG. 5 is a schematic front view to show a color image forming apparatus of a comparative example.

By the way, in the above configuration, should one desire to place the image supporting members 41 in contact with the tensed side of the transfer belt 30, the single-color toner image formers 40 and the exposers 43 may be placed below the transfer belt 30 as shown in FIG. 5. In such an arrangement, floatation toner occurring in an image forming section of each single-color toner image former 40, toner spilling at the maintenance time, and dust such as paper powder will accumulate on the exposers 43. Thereby optical systems in the exposers 43 are dirtied, causing an image defect to occur. In addition, a mechanism for replenishing the developing roller 44 with toner successively from below is required, thereby complicating the structure.

Figure 6:
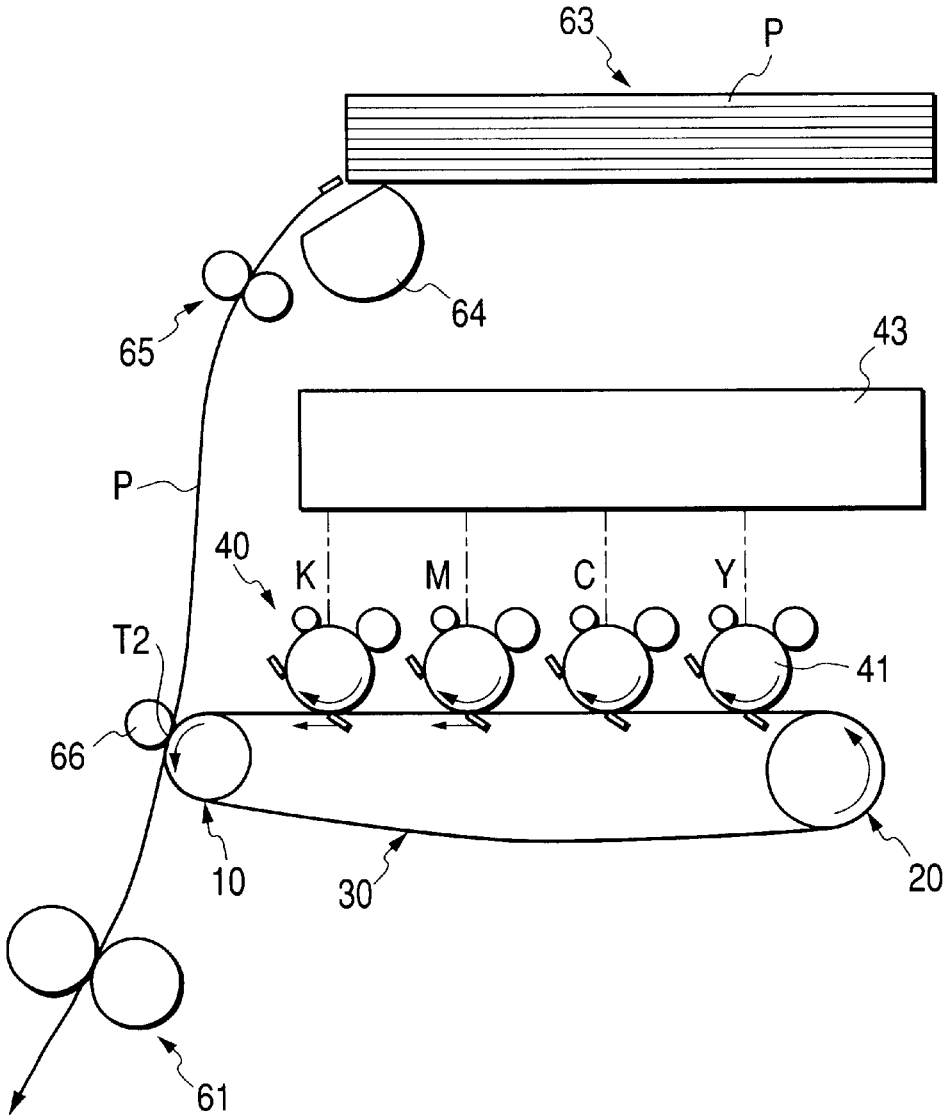
FIG. 6 is a schematic front view to show a color image forming apparatus of another comparative example.

To solve such problems, the single-color toner image formers 40 and the exposers 43 may be placed above the transfer belt 30. However, if an attempt is made to place the image supporting members 41 on the tensed side of the transfer belt 30, while forming the secondary transferring position T2 in the part of winding the intermediate transfer belt 30 around the drive roller 10, as shown in FIG. 6, the recording medium P passes through the secondary transferring position T2 downward from the upper side. Consequently, the fixing section 61 is placed below the transferring positions T1 and T2, the image forming sections (photoconductors 41), and the exposure sections (exposers 43). In such an arrangement, heat or water vapor generated from the fixing section 61 at high temperature invade into the above-mentioned sections, so that an image failure caused by temperature fluctuation, a registration shift caused by thermal expansion, an image failure caused by dew condensation, sticking of the contact parts, or the like occurs.

Besides, since the paper feeding section (the paper feeding cassette 63, etc.,) is placed in an upper part of the apparatus as shown in FIG. 6, if a large number of sheets of paper (about 500 to 1000 sheets) are stacked in the paper feeding section, the apparatus is easily distorted, shifting registration and also worsening the installation stability of the apparatus.

In contrast, according to the present embodiment, since the circulation velocity Vt of the transfer belt 30 is so set as to be lower than the circumferential velocity of each of the image supporting members 41, it is made possible to place the single-color toner image former 40 on the slack side of the transfer belt 30, and therefore the secondary transferring position T2 can be formed in the part of winding the intermediate transfer belt 30 around the drive roller 10 and the recording medium P is allowed to pass through the secondary transferring position T2 upward from the lower side. Accordingly, it is made possible to solve all above-described problems.

That is, the single-color toner image formers 40 and the exposers 43 are placed above the transfer belt 30, whereby not only preventing floatation toner from being placed in the image forming section of the single-color toner image former 40, preventing toner from spilling at the maintenance time, and preventing dust such as paper powder from causing an image defect to occur, but also facilitating the toner replenishment for the developing unit. Moreover, since the fixing section 61 is placed above the transferring positions, the image forming section, and the exposure section, heat or water vapor generated from the fixing section 61 can be prevented from invading into the above-mentioned sections, so that it is possible to prevent occurrence of an image failure caused by temperature fluctuation, a registration shift caused by thermal expansion, an image failure caused by dew condensation, sticking of the contact parts, or the like. Furthermore, since the paper feeding section (the paper feeding cassette 63, etc.,) is placed in a lower part of the apparatus, the apparatus becomes hard to distort even if a large number of sheets of paper (about 500 to 1000 sheets) are stacked in the paper feeding section, so that not only the registration is hard to shift, but also the installation stability of the apparatus is enhanced.

The present invention may also include a cleaning blade 67 for removing the remaining toner on the intermediate transfer belt 30 after secondary transfer abuts the intermediate transfer belt 30 in the part of winding the intermediate transfer belt 30 around the drive roller 10.

The cleaning blade 67 after secondary transfer acts on the circulated transfer belt 30 as resistance. Particularly it becomes a large resistance when the circulation of the transfer belt 30 is started. However, in the above configuration, the resistance of the cleaning blade 67 in the abutment part will not act as a tensile force for the transfer belt 30. Such a resistant tensile force acts only on the winding part of the transfer belt 30 around the drive roller 10. Thus, even if the abutment state of the cleaning blade 67 on the intermediate transfer belt 30 is not stable because of the friction therebetween, the unstableness will not affect any tension acting on the transfer belt 30. Therefore, the stretched condition of the intermediate transfer belt 30 becomes stable even at the initial stage of driving. Accordingly, a shift between the transferring positions of color toner images onto the intermediate transfer belt 30 is remarkably decreased even at the initial stage of image formation, so that the quality of a color image is enhanced.

The intermediate transfer belt 30 is so configured as to satisfy at least one of the following conditions:

i) a surface hardness of the transfer belt 30 is set larger than that of the image supporting member 41;

ii) a surface roughness of the transfer belt 30 is set larger than that of the image supporting member 41; and iii) an abrasive, for example, high-hardness particles, alumina, or ceramic, is added to the surface. Here, the belt surface may be impregnated with the abrasive or the abrasive may be coated on the belt surface.

Generally, the remaining toner from transfer exists on the image supporting member 41 and accumulates gradually thereon, causing so-called filming to occur as one factor of degradation of the image quality.

According to the configuration which satisfies any one of the above conditions whenever the surface of the image supporting member 41 comes in contact with the transfer belt 30, because of the difference between the circulating velocity of the transfer belt 30 and the circumferential velocity of the image supporting member 41, the surface of the image supporting member 41 is slightly shaved and is always refreshed. Therefore, the filming is prevented so that the image quality is maintained.

As a second embodiment of the invention, each circumferential velocity Vdi (>Vt) shown in FIG. 1 may be configured such that a circumferential velocity of an image supporting member 41 which is further from the driving roller 10 is higher than a circumferential velocity of an image supporting member 41 which is closer to the driving roller 10 (for example, Vd1 <Vd2 <Vd3 <Vd4).

As shown in FIG. 2, the apparatus is provided with a first gear train GT for driving the intermediate transfer belt 30 and a second gear train GD for driving the image supporting members 41. Both gear trains are driven by a single drive source gear GM. The second gear train GD is driven through the first gear train GT so that the gear train from the drive source gear GM to a gear Gd4 at the last stage is implemented as a single gear train with no branch.

That is, the drive source gear GM is fixed to an output shaft of a motor M to be driven. A gear Gt meshes with the drive source gear GM through an idle gear Gat, whereby the drive roller 10 is driven at the circumferential velocity Vt (<Vd1). A gear Gd1 meshes with the gear Gt through idle gears Ga5 and Ga4, whereby the image supporting member 41(Y) is driven at the circumferential velocity Vd1. A gear Gd2 meshes with the gear Gd1 through an idle gear Ga1, whereby the image supporting member 41(C) is driven at the circumferential velocity Vd2 (>Vd1). Likewise, a gear Gd3 meshes with the gear Gd2 through an idle gear Ga2, whereby the image supporting member 41(M) is driven at the circumferential velocity Vd3 (>Vd2). The last stage gear Gd4 meshes with the gear Gd3 through an idle gears Ga3, whereby the image supporting member 41(K) is driven at the circumferential velocity Vd4 (>Vd3).

Therefore, the second gear train GD (gears Ga5, Ga4, Gd1, Ga1, Gd2, Ga2, Gd3, Ga3, and Gd4) is driven through the first gear train GT (gears Gat and Gt), so that the gear train from the drive source gear GM to the last stage gear Gd4 is implemented as a single gear train with no branch.

According to the above configuration, since the transfer belt 30 is always maintained in a tensed state between the adjacent image supporting members, the running condition of the transfer belt 30 becomes reliably stable without wrinkles or slack between the adjacent image supporting members 41. Therefore, the transferring position T1 can be fixed uniquely to a predetermined position, so that it is made possible to provide an image with a good registration (less color-to-color shift).

Although the present invention has been shown and described with reference to specific preferred embodiments, various changes and modifications will be apparent to those skilled in the art from the teachings herein. Such changes and modifications are deemed to come within the spirit, scope and contemplation of the invention as defined in the appended claims.

For example, an intermediate transfer drum may be used as the transferring member instead of the above-described intermediate transfer belt. Alternatively, a member (a belt member, a drum member or the like) for holding and transporting a recording medium thereon may be used as the transferring member.

In addition, while each of the transfer members 51, 52, 53, and 54 in the embodiment described above is implemented as a transfer blade, the transferring members may also be implemented, for example, as a corona transfer device.

Further, of course, the driven roller 20 may be implemented as a tension roller and/or a meander regulation roller.

What is claimed is:

1. A color image forming apparatus, comprising:

a drive roller and a driven roller, a looped belt member stretched and circulated by at least the drive roller and the driven roller so as to have a slack side and a tensed side;

and a plurality of image supporting members, each supporting a single color toner image thereon, and abutting onto the slack side of the belt member to define a transferring position at which the toner image is transferred onto either the belt member or a recording medium held by the belt member, while being rotated, wherein:

a circumferential velocity of each image supporting member is determined so as to be higher than a circulation velocity of the belt member.

2. The color image forming apparatus as set forth in claim 1, wherein the circumferential velocities of the image supporting members are substantially the same as each other.

3. The color image forming apparatus as set forth in claim 1, wherein a circumferential velocity of an image supporting member which is further from the driving roller is higher than a circumferential velocity of an image supporting member which is closer to the driving roller.

4. The color image forming apparatus as set forth in claim 1, further comprising:

a first gear train, which rotates the drive roller to circulate the belt member;

a second gear train, which rotates the image supporting members, while being connected to the first gear train with no branch; and a single drive source, which drives the first gear train to thereby drive the second gear train.

5. The color image forming apparatus as set forth in claim 1, wherein a surface hardness of the belt member is greater than a surface hardness of the image supporting members.

6. The color image forming apparatus as set forth in claim 1, wherein a surface roughness of the belt member is greater than a surface roughness of the image supporting members.

7. The color image forming apparatus as set forth in claim 1, wherein the belt member includes an abrasive surface.

8. The color image forming apparatus as set forth in claim 1, further comprising a cleaning member which abuts against a part of the belt member which is wound on the drive roller, to remove toner remained on the belt member.

9. The color image forming apparatus as set forth in claim 1, further comprising a secondary transfer position, formed on a part of the belt member which is wound on the drive roller, at which the toner images transferred from the image supporting members are secondarily transferred to a recording medium, wherein the recording medium passes through the secondary transfer position upward from a lower part of the apparatus.

10. The image forming apparatus as set forth in claim 9, further comprising a fixing section at which the secondarily transferred toner image is fixed on the recording medium, wherein the fixing section is placed above the image supporting members.

11. A color image forming apparatus, comprising:

a transferring member;

at least one image supporting member, which supports a single color toner image thereon, and abutting onto the transferring member to define a transferring position at which the toner image is transferred onto either the transferring member or a recording medium held by the transferring member, while being rotated;

a first gear train, which rotates the transferring member;

a second gear train, which rotates the at least one image supporting member, while being connected to the first gear train with no branch; and a single drive source, which drives the first gear train to thereby drive the second gear train, wherein a circumferential velocity of the at least one image supporting member is higher than a circumferential velocity of the transferring member.

12. The color image forming apparatus as set forth in claim 11, wherein a plurality of image supporting members each associated with a single color toner image are provided so as to sequentially transfer the respective toner images onto the transferring member.

13. The color image forming apparatus as set forth in claim 11, wherein a surface hardness of the transferring member is greater than a surface hardness of the at least one image supporting member.

14. The color image forming apparatus as set forth in claim 11, wherein a surface roughness of the transferring member is greater than a surface roughness of the at least one image supporting member.

15. The color image forming apparatus as set forth in claim 11, wherein the transferring member includes an abrasive surface.

* * * * *

UNITED STATES PATENT AND TRADEMARK OFFICE

CERTIFICATE OF CORRECTION

PATENT NO. : 6,701,109 B2 
DATED : March 2, 2004
INVENTOR(S) : Kaneo Yoda, Nobumasas Abe and Yujiro Nomura It is certified that error appears in the above-identified patent and that said Letters Patent is hereby corrected as shown below:

Title page,
Item [54], Title, should read:
-- COLOR IMAGE FORMING APPARATUS WITH IMPROVED REGISTRATION --

Signed and Sealed this

Twenty-fourth Day of August, 2004

JON W. DUDAS
*Director of the United States Patent and Trademark Office*